United States Patent [19]

Taub

[11] 4,010,698

[45] Mar. 8, 1977

[54] MULTI-SHELVED DISPLAY ASSEMBLY

[75] Inventor: Ronald H. Taub, Highland Park, Ill.

[73] Assignee: Taub Family Trust U/A dated 9/1/67, Chicago, Ill.

[22] Filed: July 29, 1974

[21] Appl. No.: 492,513

[52] U.S. Cl. ..... 108/111; 40/145 R; 108/151; 248/174

[51] Int. Cl.[2] ..... A47B 3/00

[58] Field of Search ..... 40/124, 145; 211/182, 211/128, 129, 131, 133, 144, 148, 163; 108/111, 101, 91, 92, 94, 150, 151, 153, 156, 159; 248/150, 152, 159, 174

[56] References Cited

UNITED STATES PATENTS

| | | | |
|---|---|---|---|
| 657,661 | 9/1900 | Kinnear | 108/111 |
| 1,288,634 | 12/1918 | MacOrquodale | 248/174 X |
| 1,401,057 | 12/1921 | Elliott | 211/148 X |
| 1,431,823 | 10/1922 | Leconte | 108/111 X |
| 1,930,787 | 10/1933 | Zimmerman | 108/153 |
| 2,012,498 | 8/1935 | Cohen | 248/174 X |
| 2,488,641 | 11/1949 | Seawright | 108/94 |
| 2,689,050 | 9/1954 | Albin | 108/101 |
| 2,730,419 | 1/1956 | Watrous et al. | 108/156 |
| 2,803,513 | 8/1957 | Davey | 211/144 X |
| 2,930,638 | 3/1960 | Morrissey | 211/182 |
| 3,426,913 | 2/1969 | Abatiel | 211/177 |
| 3,684,285 | 8/1972 | Kane | 211/148 X |
| 3,805,965 | 4/1974 | Champagne | 211/163 X |
| 3,901,389 | 8/1975 | Belokin, Jr. | 248/174 X |

FOREIGN PATENTS OR APPLICATIONS

| | | | |
|---|---|---|---|
| 606,820 | 10/1960 | Canada | 211/133 |
| 345,155 | 11/1904 | France | 211/163 |
| 602,638 | 5/1948 | United Kingdom | 211/148 |

*Primary Examiner*—Marion Parsons, Jr.
*Assistant Examiner*—William E. Lyddane
*Attorney, Agent, or Firm*—Michael G. Berkman; Glenn E. Klepac

[57] ABSTRACT

A multi-shelved collapsible display assembly having an array of light weight shelves spaced longitudinally along the length of a standard comprising a lineally segmented pole structure. The standard passes through holes formed in the shelves and segments of the standard include end projections seating within sockets formed in adjacent segments, so that the shelves are accommodated within annular slots and the weight of the assembly is carried primarily by the segmented standard rather than bearing upon the light weight shelves. A cylindrical advertising display card extends between the base of the assembly and the lowermost shelf, thereby providing added structural stability.

3 Claims, 7 Drawing Figures

MULTI-SHELVED DISPLAY ASSEMBLY

BACKGROUND OF THE INVENTION

The present invention relates to collapsible assemblies used in retail stores for the promotional display of merchandise. More particularly, the invention is directed to a display assembly that is extremely light in weight and easy to assemble and to disassemble without tools and, when assembled, forms a rigid and stable structure. Many standard-carried display assemblies are known in the prior art, but each of these structures suffers from one or more serious disadvantages making it less than completely suitable for its intended purpose.

SUMMARY OF THE INVENTION

It is a principal object of the present invention to provide a display assembly having an array of vertically spaced light-weight shelves supported on a segmented standard, and in which the weight of the assembly is isolated from the shelves.

It is a related object of the invention to provide cooperating sockets and projections for coupling adjacent segments of the standard to one another and for securing shelves therebetween.

A further object of the invention is to provide annular slots in the segmented standard to support the shelves individually, without subjecting them to the weight of the portion of the assembly thereabove.

Another object of the invention is to provide a cylindrical advertising display panel that enhances structural stability of the assembly.

Additional objects and advantages will become apparent to those skilled in the art from the following specification, drawing and claims.

DESCRIPTION OF THE PREFERRED EMBODIMENT

Figure 1:
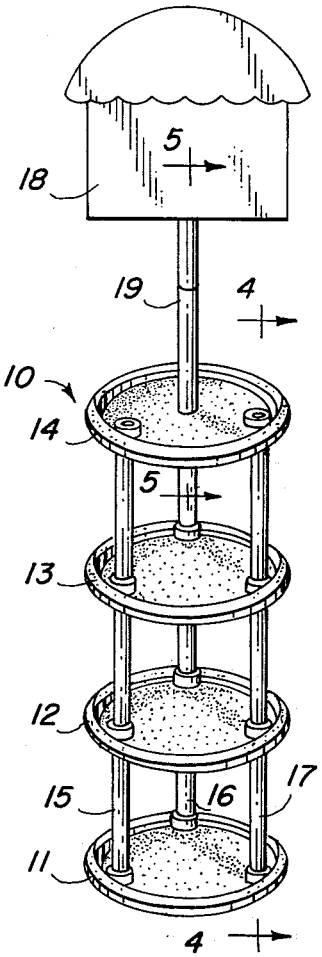
FIG. 1 is a perspective view of a preferred embodiment of the display assembly of the invention.
Figure 2:
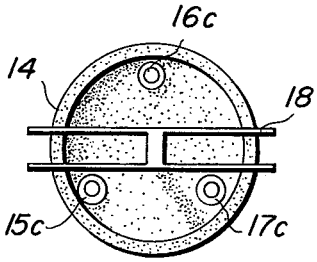
FIG. 2 is a top elevational view of the display assembly of FIG. 1.
Figure 3:
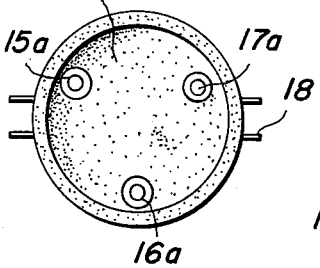
FIG. 3 is a bottom elevational view of the display assembly of FIG. 1.

Referring to FIGS. 1-6 of the drawing, the display assembly 10 includes a base 11, three round shelves 12,13,14 spaced longitudinally above the base 11, and a standard comprising three sets of in-line segmented pole structures 15,16,17. A header card 18 is carried above the assembly 10 by a fourth segmented pole 19 inserted in an opening 20 in the center of the top shelf 14.

Figure 4:
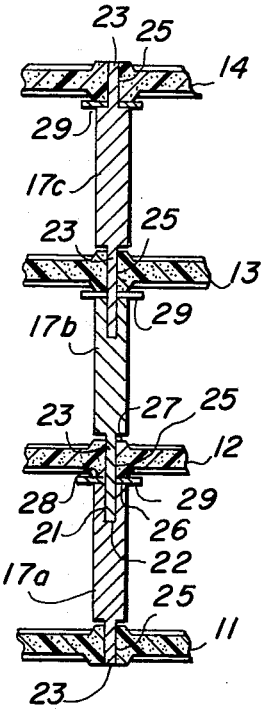
FIG. 4 is a fragmentary cross-sectional view taken on the line 4—4 of FIG. 1.
Figure 5:
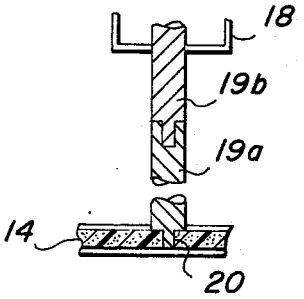
FIG. 5 is a fragmentary cross-sectional view taken on the line 5—5 of FIG. 1.
Figure 6:
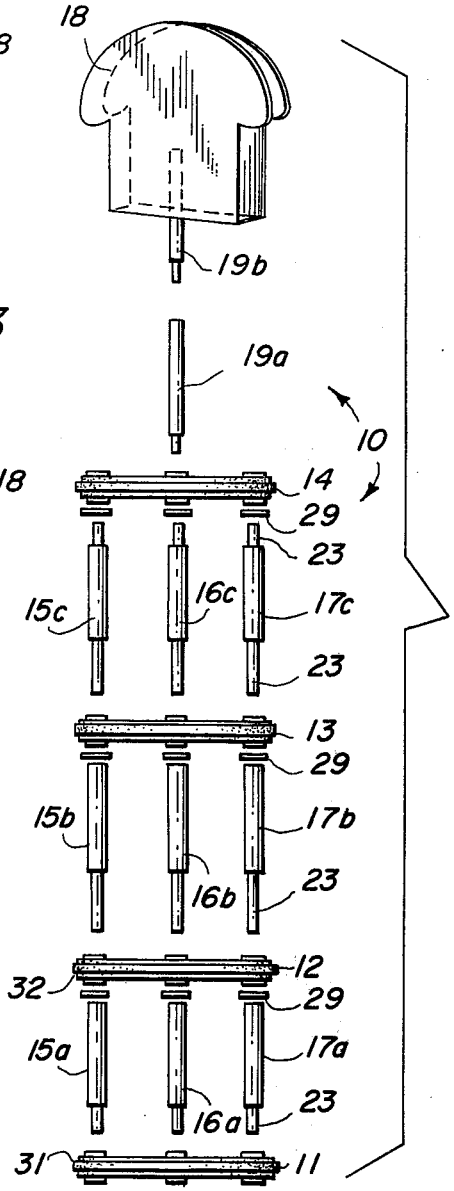
FIG. 6 is an exploded side elevational view of the display assembly of FIG. 1.

The representative pole structure 17 shown in FIGS. 4 and 6 includes three interlocking pole segments **17*a*,17*b*,17*c*. A lower or first pole segment 17*a* defines a socket 21 including an end wall 22 extending transversely thereacross. An end projection 23 of a second pole segment 17*b* extends through a hole 25 formed in the lower shelf 12 and seats within the socket 21, abutting against the end wall 22**.

The lowermost shelf 12 rests in an annular slot between the two pole segments **17*a*, 17*b*. This slot is bounded radially inwardly by the projection 23 of the middle pole segment 17*b*, below by an upper surface 26 of the body of the lower pole segment 17*a*, and above by a lower surface 27 of the body of the middle pole segment 17*b*. The upper surface 26 of the body of the lower pole segment 17*a* forms an annular weight-bearing ledge supporting the shoulder 28 of the shelf 12. Interposed between the shoulder 28 and the ledge 26 is a rigid washer 29 that enhances structural stability of the assembly 10**, especially when the assembly is constructed of light materials.

The weight of the assembly 10 is transmitted from the end projection 23 directly to the lower pole segment **17*a*, bypassing the shelf 12**. Since the weight of the assembly is isolated from the shelves, they will not bend or buckle due to the weight of articles on higher shelves even when they are constructed from light weight, foam plastic substances.

In the preferred embodiment illustrated the shelves and the base are each molded from light weight expanded polystyrene, and the pole structures are made from a solid plastic material. When greater strength is required concentric hollow paper tubes are used as the pole structures. Because such light weight materials are used the assembly can be inexpensively transported to the point of display, where it is quickly erected manually without any tools.

Figure 7:
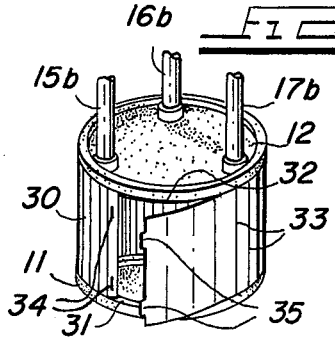
FIG. 7 is a fragmentary perspective view of the lower portion of a second embodiment of the display assembly of the invention.

In the embodiment of the invention shown in FIG. 7, a cylindrical display panel or sign 30 is wrapped around the assembly between the base 11 and lowermost shelf 12. This sign 30 bears advertising relating to the product on display, as well as adding structural stability. The sign 30 rests between a circular groove 31 formed in the base 11 and a circular groove 32 formed in the shelf 12. The sign 30 is shipped to the point of display as a rectangular sheet, where it is bent into a cylindrical panel along score lines 33. Two slits 34 are formed adjacent one end of the sign 30, and two tabs 35 at the opposite end interlock within the slits 34 to maintain the sign 30 in cylindrical form.

With the foregoing description of the invention in mind, numerous changes may be made in size, shape and material without departing from the spirit of the invention or the scope of the following claims.

What is claimed is:

1. In a multi-shelved collapsible display assembly including a base, a standard extending upwardly from said base, and an array of shelves spaced longitudinally along the length of said standard and carried thereby, said shelves being formed with holes extending transversely thereof to receive portions of the standard therethrough, said base and a lowermost shelf of said array of shelves being generally coextensive, coaxial, and each including a generally circular perimetric edge portion, said display assembly further comprising a sheetlike display panel adapted to wrap around the display assembly between the base and the lowermost shelf and to bear graphic indicia for advertisement of any articles carried by the shelves of the display assembly, said display panel being formed with a slit extending longitudinally therethrough and further comprising integral tab means, said tab means being adapted to seat within the slit to form a cylindrical display sign surrounding the display assembly between the base and the lowermost shelf, said base being formed with a groove opening upwardly and extending around an upper perimetric edge portion thereof, and said lowermost shelf being formed with a groove opening downwardly and extending around a lower perimetric edge portion thereof, said cylindrical display panel being sized to extend longitudinally between the grooves in the base and in the lowermost shelf, thereby to stabilize the display assembly against objectionable lateral displacement, said display assembly further comprising shelf weight isolating means to preclude a given shelf of said array from subjection to the weight of any shelf and shelf-carried articles thereabove in said array, said shelf weight isolating means including a shelf-support standard which is lineally segmented to provide a series of in-line pole segments interconnectable to provide a unitary integrated pole structure, said standard including a first pole segment defining a socket, a weight support end wall extending transversely of said socket, and a second pole segment adjacent the first pole segment and including a projection adapted to seat within the socket of the first pole segment and to abut said end wall, said projection, said socket, and said end wall comprising in combination coupling means and weight bearing means operative to transfer to each segment of said pole structure the full weight of each segment thereabove, and pole carried shelf support means to support the shelves in place on the standard in zones adjacent junctures of intercoupled consecutive segments of the pole structure, said support means comprising an annular weight bearing ledge encircling a longitudinal axis of said pole structure and normal thereto, and annular shoulder means on said shelves encircling and concentric with said holes formed therethrough;

whereby said shoulder means bears downwardly upon said ledge to support said shelves and shelf-carried articles on the pole structure, to obviate imposition on any shelf of the weight of the standard and the standard-carried shelves thereabove.

2. In a multi-shelved collapsible display assembly including a base, a standard extending upwardly from said base, and an array of shelves spaced longitudinally along the length of said standard and carried thereby, said base and a lowermost shelf of said array of shelves being generally coextensive and coaxial, and each including a perimetric edge portion;

the improvement wherein said display assembly further comprises a sheet-like display panel adapted to wrap around the display assembly between the base and the lower shelf and to bear graphic indicia for advertisement of any articles carried by the shelves of the display assembly; said display panel being formed with a slit extending longitudinally therethrough and further comprising integral tab means, said tab means being adapted to seat within the slit to form a display sign surrounding the display assembly between the base and the lowermost shelf;

said base being formed with groove opening upwardly and outwardly of an upper perimetric edge portion thereof, and said lowermost shelf being formed with groove opening downwardly and outwardly of a lower perimetric edge portion thereof;

said display panel being sized to extend longitudinally between the grooves in the base and in the lowermost shelf, thereby to stabilize the display assembly against objectionable lateral displacement.

3. The improvement as set forth in claim 2, wherein the groove formed in said base and the groove formed in said lowermost shelf are each annular, and wherein said display sign forms a cylindrical display panel surrounding the display assembly.

* * * * *